United States Patent [19]

Cohrs

[11] Patent Number: 5,024,472

[45] Date of Patent: Jun. 18, 1991

[54] FLUSHBOLT ACTUATOR ASSEMBLY

[75] Inventor: Richard B. Cohrs, Indianapolis, Ind.

[73] Assignee: Von Duprin, Inc., Indianapolis, Ind.

[21] Appl. No.: 506,210

[22] Filed: Apr. 9, 1990

[51] Int. Cl.[5] ..... E05C 3/16

[52] U.S. Cl. ..... 292/182; 292/DIG. 21

[58] Field of Search ..... 292/177, 182, 21, 140, 292/169, R, 187, DIG. 21

[56] References Cited

U.S. PATENT DOCUMENTS

| | | | |
|---|---|---|---|
| 2,588,356 | 3/1952 | Burgayne | 292/182 |
| 3,578,369 | 5/1971 | Coopersmith | 292/182 X |
| 4,005,886 | 2/1977 | Lirette | 292/177 |
| 4,611,840 | 9/1986 | Martin | 292/177 |

*Primary Examiner*—Richard E. Moore

*Attorney, Agent, or Firm*—Walter C. Vliet; Bernard J. Murphy

[57] ABSTRACT

The assembly has an auxiliary bolt which is pivotably mounted in a housing. The bolt is captively journalled by a removable bracket which has a pair of recesses on opposite sides thereof. A shaft integral with the bolt sets in one pair of the recesses, to effect one handed operation of the assembly, and with optional setting of the shaft in the other pair of recesses, the assembly is oppositely handed. The assembly is simply bolted to a faceplate; consequently, by removing such bolts, and removing the bracket, the bolt can be replaced or reversed in its handed disposition. An override spring is provided to protect the assembly from damage, in the event that the associated flushbolt fails to enter the strike or recess provided therefor; the spring allows the auxiliary bolt to fully retract, even through the flushbolt translation is inadequate.

16 Claims, 2 Drawing Sheets

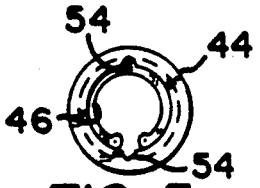
FIG. 5
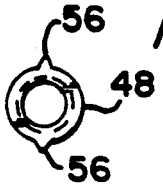
FIG. 4
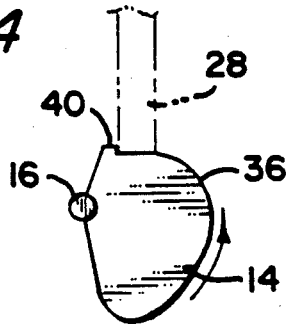
FIG. 7
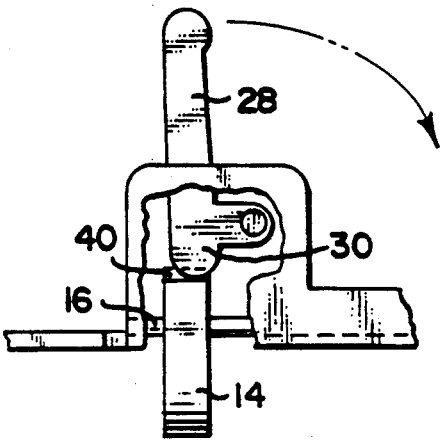
FIG. 6
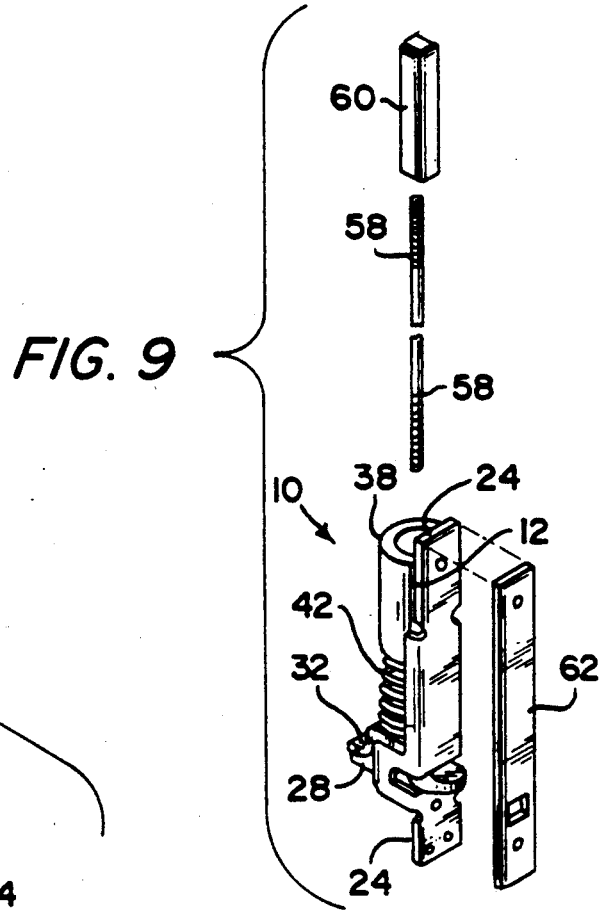
FIG. 9
FIG. 8
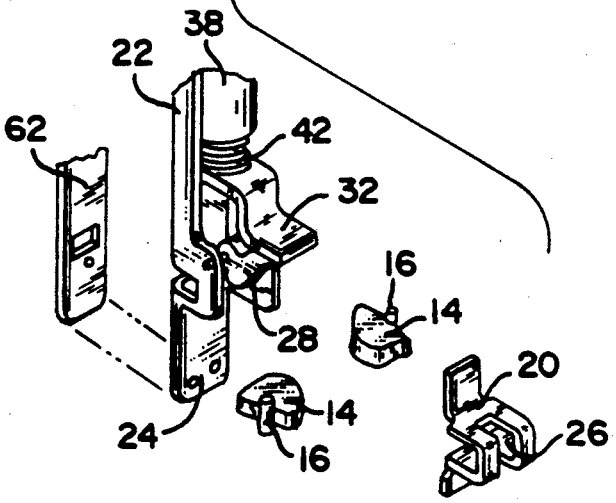

FLUSHBOLT ACTUATOR ASSEMBLY

BACKGROUND OF THE INVENTION

This invention relates, generally, to flushbolt mechanisms, and in particular to actuator assemblies for flushbolts.

Flushbolts are latching mechanisms for the inactive door of a pair of doors which have therebetween no mullion. The inactive door of such a pair is so-called as, in the circumstances, it is intended that this door not be the primary door for entry and egress. Rather, its companion, the so-called active door, is intended for primary use. To this end, the inactive door typically has a pair of flushbolts. Each of the latter comprises an auxiliary bolt which normally projects from the edge of the door which interfaces the active door. With the active door closing in confronting relationship to the inactive door, it depresses the auxiliary bolt(s). Mechanisms within the inactive door transmit the motion of the depressed auxiliary bolt(s) into vertical motion which secures square, latch bolts in recesses in the top frame and bottom sill of the inactive door. Hence, with both doors closed, the inactive door can not be opened. As the active door is opened, the auxiliary bolt(s) project from the edge thereof, and the aforesaid mechanism withdraws the latch bolts from their recesses; the inactive door, then, is free to swing open.

The mechanisms, i.e., the flushbolt actuator assemblies known in the prior art comprise linearly-displaced auxiliary bolts. Linearly-displaced auxiliary bolts require considerable force to effect retraction thereof, as the loading thereof is perpendicular to the face of the bolt. Too, the auxiliary bolts are either left-handed or right-handed, depending upon their configuration and/or disposition in the actuator assembly. Commonly, some rather involved disassembly of the actuator assemblies is required to replace, or reverse, the auxiliary bolt, to effect a change of the handed orientation.

The foregoing illustrates limitations known to exist in present flushbolt actuator assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a flushbolt actuator assembly, comprising a housing; and an auxiliary bolt; wherein said auxiliary bolt is mounted in said housing for movement, relative to said housing, between (a) an extended disposition, and (b) a retracted disposition; said housing has a longitudinal axis; and a piston subassembly; wherein said piston subassembly is mounted to said housing for movement, relative to said housing, in opposite axial directions; and means interpositioned between said bolt and said subassembly for moving said subassembly in one of said axial directions in response to a movement of said bolt to its retracted disposition; and wherein said auxiliary bolt is pivotably mounted in said housing.

The foregoing and other aspects will become apparent from the following detailed description of an embodiment of the invention when considered in conjunction with the accompanying drawing figures.

BRIEF DESCRIPTION OF THE DRAWING FIGURES

Figure 3:
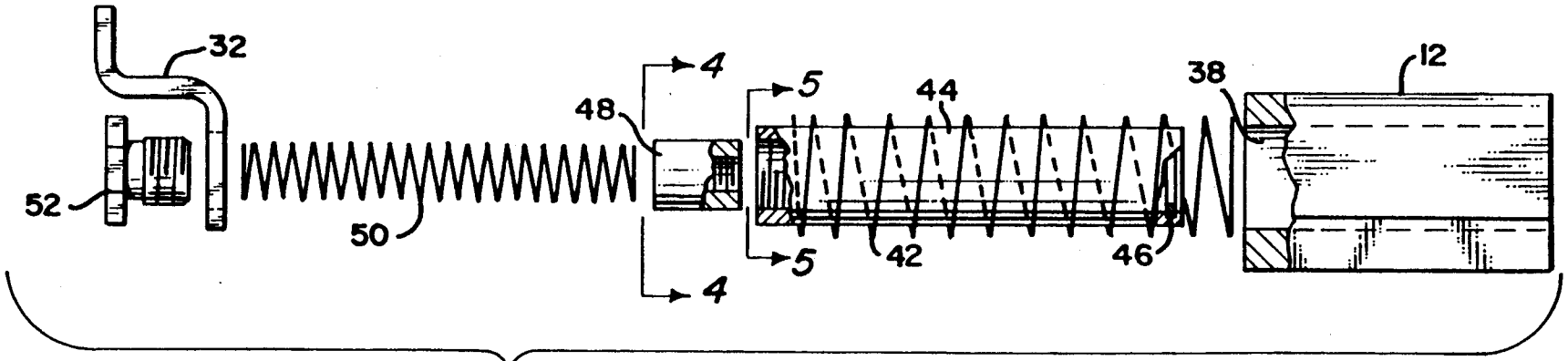
FIG. 3 is an exploded view of the piston subassembly, and cylinder.

FIGS. 4 and 5 are end views of the insert and piston, respectively, taken from references 4—4 and 5—5 of FIG. 3;

FIG. 6 is a fragmentary view of a portion of the housing and the pivotable arm which is displaced by the auxiliary bolt;

FIG. 7 is a side view of the auxiliary bolt showing its relationship to a phantomed arm;

FIG. 8 is an exploded, perspective view of a portion of the flushbolt actuator assembly showing the auxiliary bolt in both handed dispositions; and FIG. 9 is an exploded, perpective view of the flushbolt actuator assembly together with the associated threaded rod and square latch bolt.

DETAILED DESCRIPTION

Figure 1:
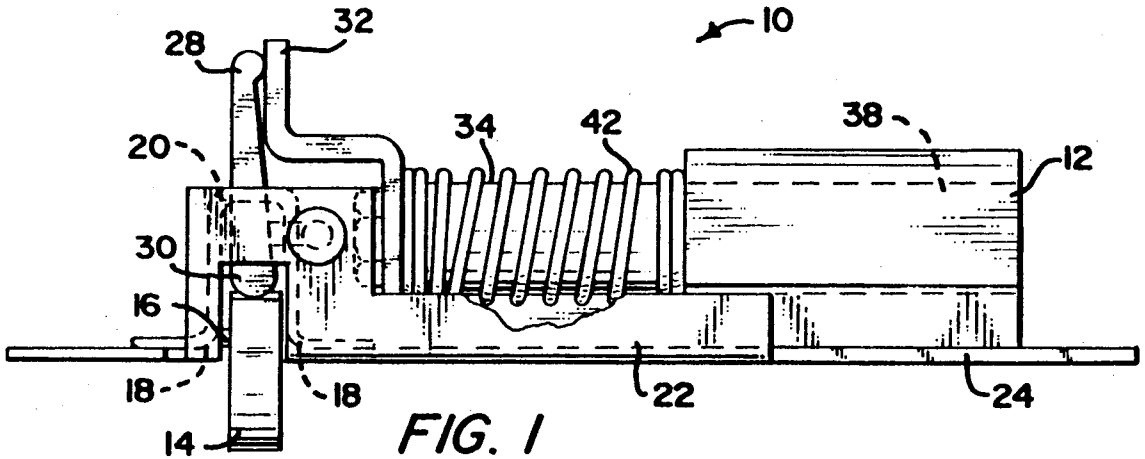
FIG. 1 is a side, elevational view of an embodiment of the novel flushbolt actuator assembly.
Figure 2:
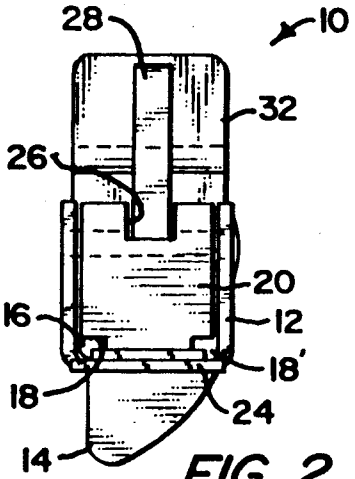
FIG. 2 is an end view of the assembly of FIG. 1, taken from the bottom of FIG. 1.

As shown in the figures, a preferred embodiment 10 of the novel flushbolt actuator comprises a housing 12 and an auxiliary bolt 14. The bolt 14 is pivotably mounted in the housing 12; bolt 14 has an integral pivot shaft 16, and the shaft is journalled in recesses 18 provided thereof in a bracket 20 which constitutes part of the housing 12. The housing comprises a generally U-shaped guide 22 and a planar platform 24, and the bracket is fastened to the platform. The bracket 20 has the recesses 18 at one side thereof, and a complementary pair of recesses 18' in the opposite side thereof. With the pivot shaft 16 journalled in recesses 18, as shown in FIG. 1, the auxiliary bolt 14 pivots counterclockwise during its retraction. If the shaft 16 was journalled in recesses 18', it would pivot in the clockwise direction during retraction. Hence, the left-or right-handedness of the actuator assembly 10 can be determined by the selection of either recesses 18 or 18' for the journalled capture of the shaft 16.

The bracket 20 has a void 26 formed therein. Adjacent to the bracket 20, and pivotably mounted across the housing 12, is an arm 28. The arm 28 has a depending lobe 30 which, with pivotable movement of the arm 28, moves through the void 26. Arm 28 also has its more prominent portion engaged with a limb 32 which is fixed at one end of a piston subassembly 34. Arm 28 engages one end of the limb 32, and the other end of the limb 32 is slidably engaged with the guide 22. With the aforecited structure, pivotable retraction of the auxiliary bolt 14 into the housing 12 causes the arcuate surface of the auxiliary bolt, which surface defines a camming surface 36, to engage the lobe 30, pivotably displaced the arm 28, and cause concomitant displacement of the piston subassembly 34. The end of the piston subassembly 34 which carries the limb 32 slides along the guide 22; the other end of the subassembly 34 enters a cylinder 38 which is removably fastened to the planar platform 24. When the bolt 14 pivots to extension from the housing 12, it is delimited in this pivotable movement by a rib 40 formed on the periphery thereof at an end of the camming surface 36. The rib 40 engages the lobe 30 to halt the pivoting of the bolt 14 at a proper extension from the housing 12.

A compression spring 42 is set about the aforesaid other end of the piston subassembly 34 for reaction between the cylinder 38 and limb 32 to urge the subassembly away from the cylinder and into biased engagement with the arm 28. Subassembly 34 comprises a hollow piston 44 having a retaining ring 46 confined within one end thereof, in a groove provided therefor. The retaining ring 46 provides a stop for an insert 48 which is slidably engaged with the interior of the piston 44. A compression spring 50 is also set within the pistion 44 to urge the insert normally toward the retaining ring 46, and a bolt 52 is threadedly engages with internal threads in the end of the piston which is remote from the retaining ring 46. The bolt 52 fixes the limb 32 securely to the end of the piston 44 and secures the spring 50 and insert 48 in the piston 44.

As can be seen, in FIG. 5 especially, the piston has a pair of grooved keyways 54 formed in the inner wall thereof. The same are provided to receive the keys 56 formed on opposite sides of the insert 48. This arrangement assures that, with translation of the insert 48 within the piston 44, the insert will not revolve in the piston. This is important, as the insert 48 is to receive an end of a flushbolt rod.

The insert 48 is internally threaded and, with reference to FIG. 9, it can be seen that flushbolt rods 58 are threaded at each end. By this means the effective length of the rods 58 can be adjusted to insure that the square flushbolts 60 will extend into the latch recesses provided therefor, and retract sufficiently to clear the recesses (to allow door opening).

As earlier noted, the active door and, in so doing, engages and forces a retraction of the auxiliary bolt 14 into the housing 12. As a result of this, the rods 58 translate to cause the bolts 60 to enter into their recesses or strikes. However, if the bolts 60 are misaligned, or if some foreign matter is lodged in one of the recesses/-strikes, and the bolts cannot latch, there would be a risk of damage to the mechanism. Forced closure of the active door and an inability of the auxiliary bolt 14 to fully retract when engaged by the active door could cause the pivot shaft 16 to shear, or the arm 28 to fracture, etc. To insure that such damage does not occur is why the insert 48 is biased by the spring 50. Spring 50 comprises an override spring which, if the bolt 60 does not latch into its strike, will yield when the auxiliary bolt 14 is retracted into the housing 12.

The disclosed embodiment 10, besides offering the override protection of spring 50, has a considerably simplified structure which makes removal and replacement or reversal of the auxiliary bolt 14 facile. It is only necessary to unbolt the actuator assembly 10 from the face plate 62 and unfasten the bracket 20 from the platform 24. Then the bolt 14 comes free, for reversal —to alter the handed disposition of the assembly 10 —or replacement. Additionally, the pivotal action of the bolt 14 requires significantly less force to displace the arm 28 and resultant displacement of the piston subassembly 34.

While the invention has been described in connection with a specific embodiment thereof, it is to be clearly understood that this is done only by way of example, and not as a limitation to the scope of the invention as set forth in the aforesaid summary thereof and in the appened claims.

I claim:

1. A flushbolt actuator assembly, comprising:

a housing; and an auxiliary bolt; wherein said auxiliary bolt is mounted in said housing for movement, relative to said housing, between (a) an extended disposition, and (b) a retracted disposition;

said housing has a longitudinal axis; and a piston subassembly; wherein said piston subassembly is mounted to said housing for movement, relative to said housing only, in opposite axial directions; and means interpositioned between said bolt and said subassembly for moving said subassembly in one of said axial directions in response to a movement of said bolt to its retracted disposition; and wherein said auxiliary bolt is pivotably mounted in said housing.

2. A flushbolt actuator assembly, according to claim 1, wherein:

said housing has a guide; and said piston subassembly has a limb slidably engaged with said guide for directing said subassembly in axial movement.

3. A flushbolt actuator assembly, according to claim 2, wherein:

said means comprises an arm pivotably mounted to said housing for engagement with said limb and for moving said limb axially.

4. A flushbolt actuator assembly, comprising:

a housing; and an auxiliary bolt; wherein said auxiliary bolt is mounted in said housing for movement, relative to said housing, between (a) an extended disposition, and (b) a retracted disposition;

said housing has a longitudinal axis; and a piston subassembly; wherein said piston subassembly is mounted to said housing for movement, relative to said housing, in opposite axial directions; and means interpositioned between said bolt and said subassembly for moving said subassembly in one of said axial directions in response to a movement of said bolt to its retracted disposition; and wherein said auxiliary bolt is pivotably mounted in said housing;

said housing has a guide;

said piston subassembly has a limb slidably engaged with said guide for directing said subassembly in axial movement;

said means comprises an arm pivotably mounted to said housing for engagement with said limb and for moving said limb axially;

said housing further has a bracket;

said bracket is removably fixed to said guide;

said arm is pivotably mounted in adjacency to said bracket;

said bracket has a void formed therein; and said arm has a depending lobe which, with pivotable movement of said arm, moves through said void.

5. A flushbolt actuator assembly, according to claim 4, wherein:

said bolt has a pivot shaft; and said bracket has means journalling said shaft on said housing.

6. A flushbolt actuator assembly, according to claim 4, wherein:

said bolt has a camming surface; and said camming surface slues through said bracket, with pivotable movement of said bolt, to engae said lobe and cause pivotable displacement of said arm.

7. A flushbolt actuator assembly, according to claim 6, wherein:

said bolt has a rib formed on an outer periphery thereof, at an end of said camming surface; and said rib engages said lobe, upon said bolt moving to its extended disposition, to delimit extension of said bolt.

8. A flushbolt actuator assembly, according to claim 5, wherein:

said journalling means comprises means for journalling said shaft to accommodate pivotable movement of said auxiliary bolt, selectively, in a first rotary direction, and in a second, opposite, rotary direction, during retraction.

9. A flushbolt actuator assembly, according to claim 6, wherein:

said journalling means comprises recesses formed in said bracket on opposite sides of said void.

10. A flushbolt actuator assembly, according to claim 1, wherein:

said bolt has a pivot shaft; and said housing has means for journalling said shaft to accommodate pivotable movement of said bolt, selectively, in a first rotary direction, and in a second, opposite, rotary direction, during retraction.

11. A flushbolt actuator assembly, according to claim 1, wherein:

said housing has a straight cylinder; and said piston subassembly is slidably engaged with said cylinder.

12. A flushbolt actuator assembly, according to claim 11, wherein:

said piston subassembly comprises a piston having means at one end for attaching thereto a flushbolt rod.

13. A flushbolt actuator assembly, according to claim 11, further including:

means interposed between said piston subassembly and said cylinder urging said piston assembly in a given direction relative to said cylinder.

14. A flushbolt actuator assembly, comprising:

a housing; and an auxiliary bolt; wherein said auxiliary bolt is mounted in said housing for movement, relative to said housing, between (a) an extended disposition, and (b) a retracted disposition;

said housing has a longitudinal axis; and a piston subassembly; wherein said piston subassembly is mounted to said housing for movement, relative to said housing, in opposite axial directions; and means interpositioned between said bolt and said subassembly for moving said subassembly in one of said axial directions in response to a movement of said bolt to its retracted disposition; and wherein said auxiliary bolt is pivotably mounted in said housing;

said housing has a straight cylinder;

said piston subassembly is slidably engaged with said cylinder;

said piston subassembly comprises a piston having means at one end for attaching thereto a flushbolt rod;

said piston is hollow; and said rod attaching means comprises an internally-threaded insert confined within said piston.

15. A flushbolt actuator, according to claim 14, wherein:

said piston subassembly further comprises means within said piston urging said insert to one end of said piston.

16. A flushbolt actuator assembly, according to claim 14, wherein:

said piston has means therewithin defining a keyway; and said insert has means defining a key guidably engaged with said keyway.

* * * * *